United States Patent [19]

Yuge et al.

[11] 4,376,813

[45] Mar. 15, 1983

[54] REVERSAL DEVELOPMENT METHOD OF ELECTROSTATIC LATENT IMAGE BY THE USE OF HIGH-RESISTIVITY MAGNETIC TONER

[75] Inventors: Shizuo Yuge, Okazaki; Toshio Yamamoto, Sakai; Susumu Sakakibara, Toyohashi, all of Japan

[73] Assignee: Minolta Camera Kabushiki Kaisha, Osaka, Japan

[21] Appl. No.: 341,148

[22] Filed: Jan. 20, 1982

[30] Foreign Application Priority Data

Jan. 30, 1981 [JP] Japan ..... 56-13505

[51] Int. Cl.[3] ..... G03G 13/09

[52] U.S. Cl. ..... 430/100; 430/122; 118/647; 118/657

[58] Field of Search ..... 430/110, 122; 118/647, 118/657

[56] References Cited

U.S. PATENT DOCUMENTS 4,166,691 9/1979 Ebi et al. ..... 355/11

4,288,515 9/1981 Yamashita et al. ..... 430/100

FOREIGN PATENT DOCUMENTS 55-133057 10/1980 Japan .

*Primary Examiner*—John D. Welsh

*Attorney, Agent, or Firm*—Wenderoth, Lind & Ponack

[57] ABSTRACT

An improved reversal development method of visualizing an electrostatic latent image through reversal development, including the steps of: forming a magnetic brush around an outer circumferential surface of a developing sleeve by the use of a developer composed of high-resistivity toner having a resistance value of $10^{13}$ Ωcm or more under an electric field of $10^4$ V/cm and a charge amount of 5 to 15 μQ/g per unit mass generated by gaseous discharge; and applying simultaneously an a.c. bias, and a d.c. bias approximately equal to a sum of a potential of an image portion of the electrostatic latent image and a potential of its non-image portion to the magnetic brush.

6 Claims, 6 Drawing Figures

REVERSAL DEVELOPMENT METHOD OF ELECTROSTATIC LATENT IMAGE BY THE USE OF HIGH-RESISTIVITY MAGNETIC TONER

BACKGROUND OF THE INVENTION

The present invention generally relates to development methods of electrostatic latent images and more particularly, to a reversal development method of electrostatic latent images by the use of high-resistivity magnetic toner.

Conventionally, there has been proposed a reversal development method for practical applications by the use of electrically conductive magnetic toner, whereby a developing device can be made simple in structure and easy in maintenance, with elimination of problems related to deterioration of developer due to the fatigue. However, in the case where the known reversal development method is applied to copying apparatuses of toner image transfer type, serious problems as follows may arise. Namely, in the case where the known reversal development method using the electrically conductive magnetic toner is applied to copying apparatuses of the above-described type, the development by the electrically conductive magnetic toner is performed through an electric charge injecting phenomenon, so that the toner which is caused to adhere to the image portion of the electrostatic latent image by the development is formed into one layer and thus, the development maintains the toner image, i.e. the developed image stable in quality but is limited, in its application, to development of low density images. Furthermore, since the toner itself is electrically conductive, the palarity of the toner is readily caused to change during transfer of the toner image, and a so-called "blow off" phenomenon takes place in which the toner once transferred onto the transfer paper sheet is separated from the transfer paper sheet, thereby resulting in a reduction in the transfer efficiency or indefinite transferred images.

Accordingly, as a matter of fact, it is generally considered necessary at present that the toner to be used for the reversal development which may be applied to the above described copying apparatus, should be electrically insulative or highly resistant. Therefore, for making it possible to effect the reversal development so as to obtain a positive image from a negative original, while employing the electrically insulative or high-resistivity toner, it has been inevitable to selectively adopt one system (1) in which the polarity of the electrostatic latent image formed on a surface of an electrostatic latent image carrier, i.e. charged polarity on the surface of the photoreceptor is changed over, or another system (2) in which toners having different charged polarities are changed over for use in a dual component developing material composed of a mixture of carrier and toner, with respect to the normal development for obtaining a positive image from a positive original.

However, since, in the above-described reversal development methods (1) and (2), the toner is caused to adhere to a portion (i.e. an image portion, more specifically a portion corresponding to a white image of the original), from which the electric charge of the latent image is erased, through electrostatic repulsive force, fogging of toner cannot be avoided. Furthermore, the method (1) has a disadvantage that the sensitivity of the photoreceptor varies in the cases of the normal development and the reversal development, while in the method (2), there is an inconvenience that the copying apparatuses are required to be exclusively used as special purposes apparatus for the reversal development because it is practically difficult to use two kinds of toner through changeover thereof.

SUMMARY OF THE INVENTION

Accordingly, an essential object of the present invention is to provide a practical reversal development method which enables reversal development of electrostatic latent images by the use of high-resistivity magnetic toner, with substantial elimination of the disadvantages inherent in conventional reversal development methods of this kind.

Another important object of the present invention is to provide a reversal development method as described above and applicable to an electrophotographic copying apparatus of toner image transfer type, which enables normal development and reversal development through a simple arrangement.

A still another object of the present invention is to provide a reversal development method as described above by which a reversal development image of remarkably excellent quality is obtained.

In accomplishing these and other objects according to one preferred embodiment of the present invention, there is provided an improved reversal development method of visualizing an electrostatic latent image through development, comprising the steps of: forming a magnetic brush around an outer circumferential surface of a developing sleeve accommodating a magnet therein by the use of a developer composed of high-resistivity magnetic toner having a resistance value of $10^{13}\Omega$cm or more under an electric field of $10^4$ $\nabla$/cm and a charge amount of 5 to 15 $\mu$Q/g per unit mass generated by gaseous discharge; rubbing a surface of an electrostatic latent image carrier bearing the electrostatic latent image thereon with said magnetic brush; and applying simultaneously to the magnetic brush during the rubbing, an a.c. bias, and a d.c. bias approximately equal to a sum of a potential of an image portion of the electrostatic latent image and a potential of a non-image portion thereof.

In accordance with the present invention, practical reversal development can be performed through a simplified arrangement of an electrophotographic copying apparatus of toner image transfer type and a reversal development image of remarkably excellent quality can be obtained.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
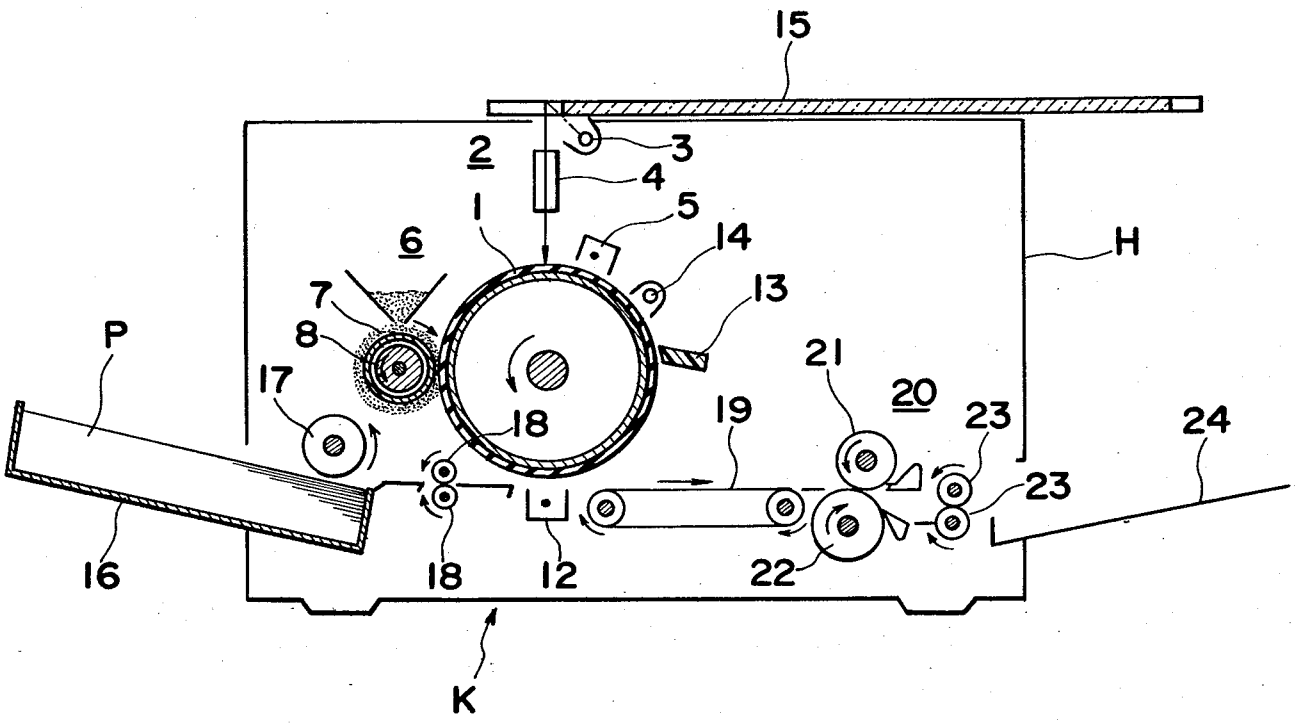
FIG. 1 is a schematic side sectional view of an electrophotographic copying apparatus of toner image transfer type to which a reversal development method according to the present invention is applied.

Referring now to the drawings, there is shown in FIG. 1, an electrophotographic copying apparatus K of toner image transfer type to which a reversal development method according to the present invention is applied.

Hereinbelow, an arrangement and operations of the electrophotographic copying apparatus K will be described briefly with reference to FIG. 1. The electrophtographic copying apparatus K includes a photoreceptor drum 1 which is rotatably mounted approximately at a central portion of an apparatus housing H for rotation in the counterclockwise direction, and around which various processing elements such as, a corona charger 5, an optical system 2, a developing device 6, a transfer charger 12, a cleaning blade 13, an eraser lamp 14, etc. are sequentially disposed along the circumference of the photoreceptor drum 1 in a known manner so as to process the surface of the photoreceptor drum 1 as the photoreceptor drum 1 rotates. An original platform 15 is reciprocatingly provided above the apparatus housing H. In response to the leftward movement of the original platform 15, an original (not shown) placed on the original platform 15 is sequentially illuminated by a light source 3. The surface of the photoreceptor drum 1 to which a predetermined electric charge has been already imparted by the corona charger 5 is subjected to exposure by the reflected light from the original through an image transmitter 4 formed by a plurality of graded index fibers in bundled configuration, as the photoreceptor drum 1 rotates in the counterclockwise direction, so that an electrostatic latent image corresponding to an image of the original is formed on the surface of the photoreceptor drum 1.

In response to the counterclockwise rotation of the photoreceptor drum 1, the electrostatic latent image is brought to the developing device 6 where the electrostatic latent image is developed into a visible toner image by a magnetic brush formed on a developing sleeve 7 in the developing device 6, and then, the toner image is brought to a transfer station.

Meanwhile, transfer paper sheets P which are stacked in a cassette 16 disposed at a lower left portion of the apparatus housing H, are fed towards a pair of timing rollers 18, one sheet by one sheet, through rotation of a paper feeding roller 17 rotatably provided in contact with the leading edge of the uppermost sheet of the stack of the transfer paper sheets P. The transfer paper sheet P is further fed, through rotation of the timing rollers 18 in synchronization with the rotation of the photoreceptor drum 1, to the transfer station where the toner image on the photoreceptor drum 1 is transferred onto the transfer paper sheet P by an electric discharge phenomenon of the transfer charger 12 with the transfer paper sheet P being in close contact with the photoreceptor drum 1. Then, the transfer paper sheet P bearing the transferred toner image is separated from the photoreceptor drum 1 by utilizing a rigidity of the transfer paper sheet P itself, or a separation pawl provided as necessary, and then, is transported by means of a transport belt 19 through a heat fixing device or a pressure fixing device 20, whereat the toner image on the transfer paper sheet P is subjected to heat fixing or pressure fixing by a pair of fixing rollers 21 and 22. The transfer paper sheet P having the fixed image thereon is finally discharged, through a pair of outlet rollers 23 provided at a lower right portion of the apparatus housing H, onto a copy receiving tray 24 projecting out of the appratus housing H.

It should be noted that, since the photoreceptor drum 1 is arranged to continue rotating after separation of the transfer paper sheet P therefrom, residual toner is removed from the surface of the photoreceptor drum 1 by the cleaning blade 13 and then, residual electric charge is also eliminated therefrom by the eraser lamp 14.

Thus, one cycle of the copying operations is completed, so that copying is performed through repetition of the above-described one cycle of operations thereafter.

Figure 2:
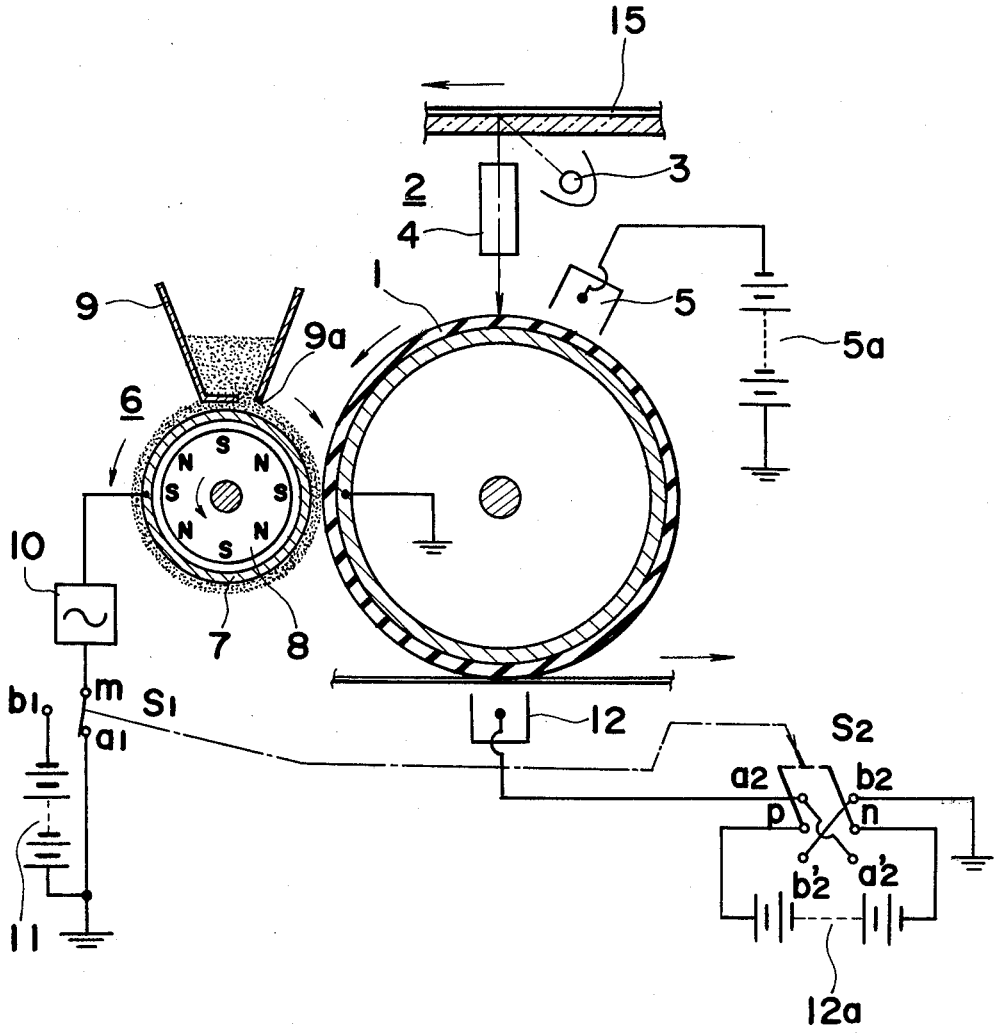
FIG. 2 is a view showing on an enlarged scale, a main portion of the copying apparatus of FIG. 1, FIGS. 3 and 4 are fragmentary side sectional views explanatory of a mechanism of development by the copying apparatus of FIG. 1, and FIGS. 5 and 6 are graphs showing density of a developed image against surface potential of an electrostatic latent image in the case of normal development and reversal development by the copying apparatus of FIG. 1, respectively.

Referring now to FIG. 2, there is shown the developing device 6 including a developing sleeve 7, a magnetic roll 8 accommodated in the developing sleeve 7, and a toner supply tank 9 disposed above the developing sleeve 7. The magnetic roll 8 is magnetized on the outer circumference so that N and S poles may be disposed alternately. It is to be noted that an end portion 9*a* of a supply opening of the toner supply tank 9 functions as a bristle-height regulating plate. Meanwhile, a power source 10 for an a.c. development vias is connected to the developing sleeve 7. The a.c. development bias from the power source 10, and a d.c. development bias for reversal development from a power source 11 for the d.c. development bias, can be applied simultaneously through superposition to the developing sleeve 7 via a switch S1 including a common contact m, a earthed contact a1 and a negative contact b1. The common contact m can be selectively changed over to either one of the earthed contact a1 and the negative contact b1.

In the case of normal development, it is so arranged that the a.c. development bias is applied to the developing sleeve 7, which is grounded through the contact a1. Meanwhile, in the case of reversal development, it is so arranged that the a.c. development bias from the power source 10 and the d.c. development bias of negative polarity from the power source 11 are simultaneously applied to the developing sleeve 7 through the negative contact b1.

Meanwhile, since the corona charger 5 is connected to a negative terminal of a d.c. power source 5*a*, a d.c. voltage of negative polarity is applied to the corona charger 5 during both normal development and reversal development.

The transfer charger 12 is connected to a d.c. power source 12*a* through a double throw switch S2 for changeover of polarity including common contacts n and p, and contacts a2, b2, a'2 and b'2. The double throw switch S2 is actuated in association with the switch S1. It is so arranged that, in the case of normal development, the common contacts n and p are respectively brought into contact with the contacts a'2 and b'2 so that a d.c. voltage of negative polarity may be applied to the transfer charger 12, while in the case of reversal development, the common contacts n and p are respectively changed over to the contacts a2 and b2 so that a d.c. voltage of positive polarity may be applied to the transfer charger 12.

Then, a mechanism of development by the copying apparatus K will be described with reference to FIGS.

Figure 3:
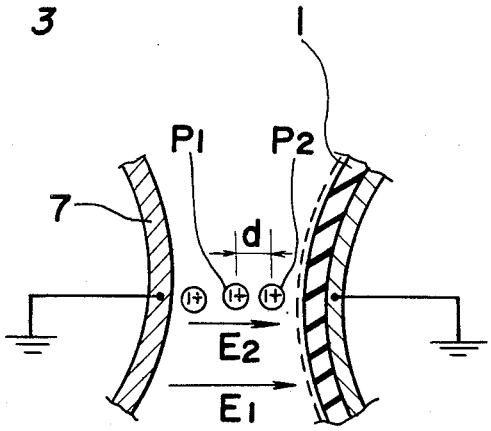

3 and 4, hereinbelow. As shown in FIG. 3, firstly electric field $E_1$ is produced between the developing sleeve 7 and the photoreceptor drum 1 by electric charge of an electrostatic latent image formed on the photoreceptor drum 1. At this moment, high-resistivity magnetic toner in a development region is polarized and thus, positive and negative polarized electric charge is produced in the toner. Assuming that electric field $E_2$ is produced by the polarized electric charge, electric field $E_0$ between a toner particle P1 and a toner particle $P_2$ is given by the following formula:

$$E_0=E_1+E_2$$

Let a distance between the toner particles $P_1$ and $P_2$ be d, a voltage drop V therebetween is expressed by the formula:

$$V=E_0 \cdot d$$

In the case where the value of V exceeds a voltage for starting gaseous discharge which is determined by a Paschen's curve, the gaseous discharge takes place between the toner particles $P_1$ and $P_2$. At this moment, the toner particles are respectively charged to positive and negative polarities by positive and negative ions, whereby the electrostatic latent image is developed by the toner of opposite polarities.

Figure 4:
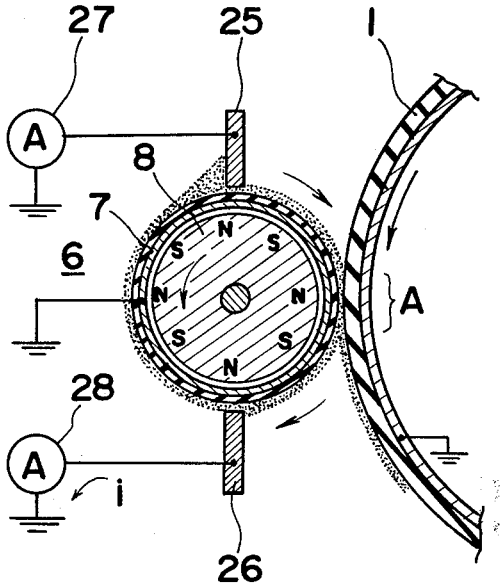

The above-described phenomenon takes place in a development region A as shown in FIG. 4. Electrode plates 25 and 26 which are respectively grounded through ampere meters 27 and 28 are provided above and below the developing sleeve 7, respectively. When flow of electric current in the above-described arrangement is observed, no electric current flows in the electrode plate 25, and electric current flows in a direction indicated by an arrow i in the electrode plate 26 when the charged polarity of the electrostatic latent image is negative. Such flow of electric current as above takes place due to facts that, since the toner is not charged until it is brought to the development region A, the toner is not provided with electric charge between the electrode plate 25 and the development region A, and that the toner provides with a substantially negative polarity between the development region A and the electrode plate 26. It should be noted here that the developing sleeve 7 is provided with an insulating coating on its outer circumferential surface with an electrically condoctive portion of the developing sleeve 7 inside the insulating coating being grounded in the case of FIG. 4, while in the case of FIGS. 1 to 3, the developing sleeve 7 is not provided with the insulating coating on the outer circumferential surface.

Meanwhile, when the high-resistivity magnetic toner is merely rubbed against the electrostatic latent image, the above-described geaseous discharge is unstable, thereby resulting in the insufficient development efficiency, image quality, etc. In this connection, it was discovered by the present inventors that when an a.c. development bias is applied to the magnetic brush, the gaseous discharge is maintained stable and polarization of the toner is accellerated, thus improving the development efficiency, image quality, etc. Furthermore, since in the development method of the present invention, the toner is charged to positive and negative polarities in the development region, reversal development can be performed by applying to the magnetic brush simultaneously, the a.c. development bias, and a d.c. development bias approximately equal to a sum of a potential of an image portion of the electrostatic latent image and a potential of a non-image portion thereof. It is to be noted here that, during the reversal development above, electric current of a polarity opposite to that of the electrostatic latent image is required to be applied to a transfer means of the toner image.

Now, various conditions in this embodiment of the present invention will be described in detail, hereinbelow.

[I] Electrographic photoreceptor drum

Type of photoreceptor: $CdS \cdot nCdCO_3$ resinous photoreceptor (Surface roughness of 3 μm or less)

Charging potential: −800 V

Circumferential speed: 100 mm/sec

In the case of normal development, the potential of the electrostatic latent image is −800 V at the image portion (a portion corresponding to a back image of the original) and −300 V at the non-image portion, while, in the case of reversal development, the potential of the electrostatic latent image is −300 V at the image portion (a portion corresponding to a white image of the original) and −800 V at the non-image portion.

Meanwhile, when a binder type photoreceptor finished to a surface roughness of 3 μm or less as described above is used, the efficiency of development by the high-resistivity magnetic toner is improved and more specifically, such a deficiency that central portion of the solid image are not developed is eliminated. Namely, in the case of the binder type photoreceptor, even if uniform electric charge is supplied thereto, the potential of the surface of the photoreceptor is caused to change locally due to a a difference in dielectric constant between the photoconductive fine particles and the binder resin so as to produce non-uniform electric field strength, so that the high-resistivity magnetic toner which have been subjected to the locally strong electric field is readily capable of being provided with the polarized electric charge larger than a predetermined value necessary for development.

[II] Developing sleeve

Material: Stainless steel (non-magnetic, electrically conductive)

Diameter: 32 mm

Rotational speed: 40 rpm (counterclockwise)

It is to be noted that the developing sleeve may be provided with an insulating coating on its outer circumferential surface as shown in FIG. 4.

[III] Magnetic roll

Number of magnetic poles: 8

Magnetic flux density: 900 G

Rotational speed: 1300 rpm (counterclockwise)

In an arrangement of combination of the above-described developing sleeve and magnetic roll, a developer is transported in the clockwise direction along the outer circumferential surface of the developing sleeve mainly in accordance with the counterclockwise rotation of the magnetic roll with the bristle-height of the toner being regulated by the end portion 9*a* of the supply opening of the toner supply tank 9 so that the surface of the photoreceptor drum may be rubbed with the developer, whereby the electrostatic latent image is developed.

Meanwhile, the above-described arrangement may be replaced by another arrangement in which the developer is transported only by the rotational drive of the magnetic roll with the rotational drive of the developing sleeve being stopped.

It is to be noted that, in this embodiment, the low speed counterclockwise rotational drive of the developing sleeve acts so as to decrease the transport speed of the developer.

On the other hand, another arrangement above may be replaced by still another arrangement in which the developer is transported only by the rotational drive of the developing sleeve with the rotational drive of the magnetic roll being stopped, but, in this case, the developing sleeve is required to be rotated in the direction opposite to that of this embodiment, i.e. in the clockwise direction. However, since in the still another arrangement as above, the developer in the development region is not subjected to magnetic agitation due to the rotation of the magnetic roll, the development efficiency is decreased, so that this arrangement is not necessarily preferable.

[IV] A.C. development bias

Frequency: 400 Hz

Voltage: 2,000 V (peak to peak voltage)

The a.c. development bias may be applied to the magnetic brush through the bristle-height regulating plate. However, in this case, the developing sleeve is required to be provided with the insulating coating on its outer circumferential surface.

[V] D.C. development bias

Only during reversal development, a d.c. development bias of −1,100 V equal to a sum of a potential of −300 V of the image portion of the electrostatic latent image and a potential of −800 V of the non-image portion thereof is applied to the developing sleeve. Accordingly, during both normal development and reversal development, a potential difference between the image portion and the developing sleeve is maintained constant, i.e. at 800 V.

[VI] Development gap 0.35 mm

[VII] Bristle-height regulating plate

Stainless steel (non-magnetic, electrically conductive)

It is usually desirable that the bristle-height regulating plate be grounded, but in the case where the a.c. development bias is applied to the magnetic brush through the bristle-height regulating plate as described earlier, the bristle-height regulating plate is connected to the power source of the development bias.

Meanwhile, the bristle-height regulating end portion of the bristle-height regulating plate may be coated for insulation.

On the other hand, even in the case where the a.c. development bias and the d.c. development bias are applied to the magnetic brush through the developing sleeve, if another d.c. bias is applied to the bristle-height regulating plate irrespective of the polarity, electric charge generated by gaseous discharge is supplied to the developer efficiently before the developer is brought to the development region, so that the development efficiency is improved in comparison with that of the arrangement in which electric charge is not supplied to the developer before the developer is brought to the development region.

[VIII] Bristle-height regulating gap 0.25 mm

The above value is determined in accordance with the value of the development gap and it was testified experimentally by the present inventors that the bristle-height regulating gap should preferably satisfy the following condition so as to maintain development proper:

$$0 \leqq (DG - BG) \leqq 0.2 \text{ mm}$$

where:

DG: development gap, and

BG: bristle-height regulating gap.

Namely, if the value of (DG−BG) becomes smaller than zero, the developer is excessively transported to the development region, so that magnetic agitation of the developer in the development region becomes inactive and thus, the development efficiency is decreased.

On the other hand, if the value of (DG−BG) exceeds 0.2 mm, the developer to be transported to the development region is reduced in amount and thus, the development efficiency is decreased.

[IX] Developer

One-component developer for pressure fixing composed of high-resistivity magnetic toner

| | |
|---|---|
| Composition: | Polyethylene (low molecular compound) 40 wt. % "Microcrystalling Wax" (name used in trade and manufactured by Mobil Oil Corporation, Japan) |
| | Magnetic material 50 wt. % "Magnetite" (name used in trade and manufactured by Titan Kogyo Kabushiki Kaisha, Japan) |
| | Ethylene vinyl acetate 8 wt. % "EVA" (name used in trade and manufactured by Mitsui Polychemical Co., Ltd., Japan) |
| | Carbon black 2 wt. % "#50" (manufactured by Mitsubishi Chemical Industries, Ltd., Japan) |

These components as above are heated, kneaded, and then, crushed and classified into particles of an average diameter of 14 to 16 μm.

| | |
|---|---|
| Resistance value: | $10^{14}$ Ωcm or more (measured under an electric field of $10^4$ V/cm and a load of 270 g/cm$^2$) |
| Amount of charge per unit mass generated by gaseous discharge: | 5 to 15 μQ/g |

It should be noted that, since the toner having a resistance value less than $10^{13}$Ωcm becomes electrically conductive at the image transfer, the toner image on the photoreceptor drum cannot be transferred onto the transfer paper sheet by the transfer charger.

It is also to be noted that, since the toner having a resistance value of $10^{13}$Ωcm or more under an electric field of $10^4$ V/cm, is sufficiently insulating at the image transfer, the above-described transfer can be satisfactorily performed. The amount of charge per unit mass generated by gaseous discharge means amount of charge per unit mass held by the toner which adhered to the electrostatic latent image when the electrostatic latent image having a voltage of 1,000 V is developed by the use of the developing device according to this embodiment (However, the a.c. development bias is not applied to the developing sleeve and the developing sleeve is grounded.).

More concretely, the value equals an integrated value of electric current for the development which is produced during the development (i.e. amount of charge which has moved between the developing sleeve and the photoreceptor during the development) divided by weight of the toner which has adhered to the electrostatic latent image during the development.

Meanwhile, since the amount of charge which has moved between the developing sleeve and the photoreceptor during the development can be obtained indirectly from potential drop due to the development, the value of the amount of charge divided by the weight of the toner which has adhered to the electrostaitc latent image during the development also gives the amount of charge per unit mass generated by gaseous discharge. It was testified by the present inventors that the above-described two methods give approximately the same value.

The present inventors have discovered through experiments on normal development and reversal development by the use of high-resistivity magnetic toner having various compositions, resistance values, and amount of charge per unit mass generated by gaseous discharge, that both normal development and reversal development can be performed properly when the amount of charge per unit mass generated by gaseous discharge ranges from 5 to 15 μQ/g.

Hereinbelow, representative results of the experiments will be described with reference to Table 1, FIGS. 5 and 6.

TABLE 1

| High-resistivity magnetic toner | A | B | C | D |
|---|---|---|---|---|
| Composition (wt. %) | | | | |
| Polyethylene (low molecular compound) | 40 | 40 | 40 | 38 |
| Magnetic material | 50 | 50 | 50 | 50 |
| Ethylene vinyl acetate | 8 | 7 | 5 | 10 |
| Carbon black | 2 | 3 | 5 | 2 |
| Resistance value (Ωcm) | more than $10^{14}$ | $6.0 \times 10^{13}$ | $5.0 \times 10^{12}$ | more than $10^{14}$ |
| Amount of charge per unit mass generated by gaseous discharge (μQ/g) | 10 | 20 | 30 | 3 |

As the result of the experiments, it was found out that toner A provides proper development and transfer while toner C causes improper transfer. Meanwhile, toner B caused remarkable fog in addition to low development density, while toner D was inferior in reproducibility of gradation of the image. Meanwhile, the toner A is used in this embodiment.

Figure 5:
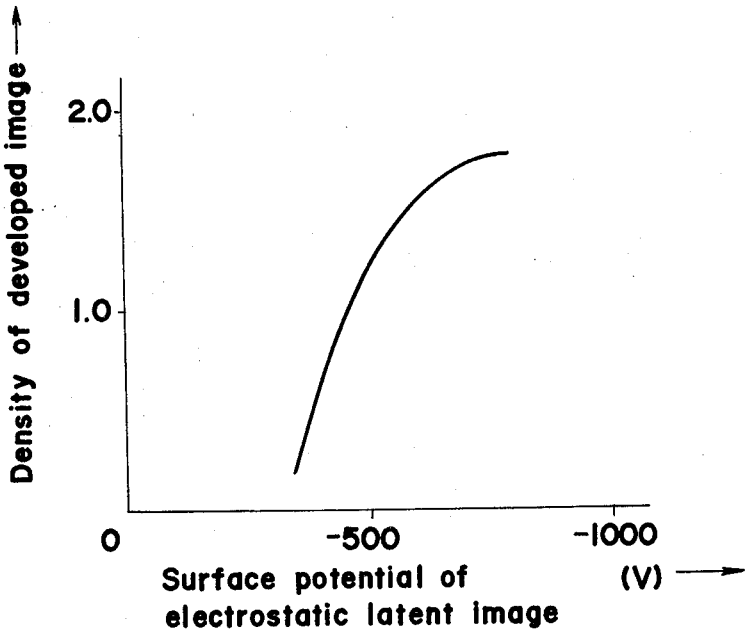
Figure 6:
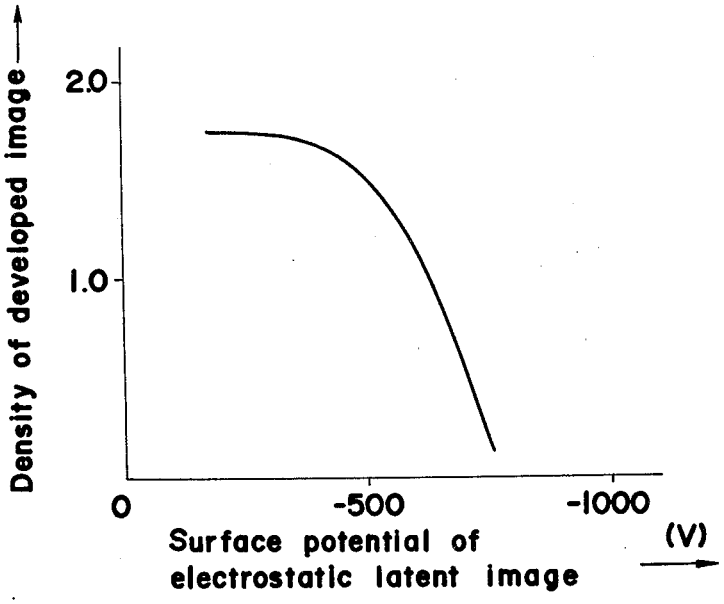

On the other hand, FIGS. 5 and 6 show density of the development image against surface potential of the electrostatic latent image in the case of normal development and reversal development by the use of the toner A, respectively. As shown in FIGS. 5 and 6, the toner A gives a proper electrostatic contrast width Vc of 350 V.

Generally, the electrostatic contrast width Vc is given by the formula:

$$Vc = |Vo - Vs|$$

where:

Vo: potential of the electrostatic latent image which results in substantially saturated development density, and Vs: potential of the electrostatic latent image which can be substantially developed.

In consideration of unavoidable variation of charged potential of the electrostatic latent image, reproducibility of gradation, etc., the electrostatic contract width Vc of 200 to 400 V is desirable for practical use.

Meanwhile, experiments by the present inventors showed that, when the high-resistivity magnetic toner has the charge amount of 5 to 15 μQ/g per unit mass generated by gaseous discharge, the electrostatic constrast width of the high-resistivity magnetic toner approximately ranged from 200 to 400 V. As the electrostatic constrast width becomes smaller, namely an inclination angle of the density curve shown in FIGS. 5 and 6 becomes larger, the potential Vs of the electrostatic latent image which can be substantially developed is usually increased while the reproducibility of gradation is aggravated.

On the other hand, as the electrostatic contrast width becomes large, namely the inclination angle of the above-described density curve becomes small, the optical system for illuminating the original is required to be arranged so that light decay of the photoreceptor due to the image projection may be increased and thus, heat generated by the light source is increased. However, in the case of toner having a density curve similar to that of the toner A, even if charged potential of the electrostatic latent image is lowered to some extent, it is possible to perform proper development without aggravation of the reproducibility of gradation. For example, it was testified by the present inventors that, even in the case where the charged potential of the photoreceptor drum is changed to −600 V and the d.c. development bias of ±200 V (+200 V and −200 V in the case of normal development and reversal development, respectively) in addition to the foregoing development bias is applied to the developing sleeve, development can be performed properly as in the case of development under conditions prior to the above-described changes. It is to be noted that this result in an advantage that formation of pin holes, etc. on the surface of the photoreceptor due to electric discharge during charging can be reduced by restricting the charged potential of the surface of the photoreceptor to a low level.

Furthermore, the voltage value and frequency of the a.c. development bias should be set to respective optimum values so that non-uniform density or discharge pattern may not be produced on the developed image. Namely, the non-uniform density or discharge pattern is produced on the developed image in accordance with a peak value of the electric field which is formed between the photoreceptor drum and the developing sleeve by applying the a.c. development bias to the developing sleeve.

The peak value of the electric field is given by the following formula:

$$E_G = (|Vo| + |V_{AC}|)/D_G$$

where:

$E_G$: peak value of electric field, (V/μm),

Vo: charged potential of photoreceptor (V), $V_{AC}$: peak value of a.c. development bias, (V) (zero to peak voltage), and $D_G$: development gap (μm).

A number of experiments carried out by the present inventors showed that, in the case where the development gap, and the charged potential of the photoreceptor range from 0.2 to 0.65 mm and from 400 to 1,200 V, respectively, the copied image has insufficient density in the case of the electric field peak value of 4.2 V/μm or less and the discharge pattern is produced in the case of the electric field peak value of 6.2 V/μm or more. Accordingly, the electric field peak value is required to range from 4.2 to 6.2 V/μm.

Meanwhile, assuming that a contact length in the direction of the motion of the photoreceptor drum between the surface of the photoreceptor drum and the magnetic brush is x mm and the circumferential speed of the surface of the photoreceptor drum is y mm/sec, the copied image has non-uniform density when frequency of the a.c. development bias is less than y/x Hz. The occurrence of the non-uniform density above seems to lead to a conclusion that, at least one cycle of the a.c. development bias should be applied to the magnetic brush while one point on the surface of the photoreceptor drum passes through the development region, namely the frequency of the a.c. development bias should be y/x Hz or more. It is considered that, an upper limit of the frequency is not especially restricted by a critical value but the frequency is preferably 1,000 Hz or less in consideration of increase of leakage current.

Furthermore, it is desirable that the voltage value of the a.c. development bias is adjustable in accordance with variations in the resistance value of the high-resistivity magnetic toner or in the charged potential of the surface of the photoreceptor, within a range where the above described non-uniform density or discharge pattern is not formed on the copied image. This adjustment is necessary because, even if the voltage value of the a.c. development bias has been once determined, the image density is caused to change in actual use due to variation of the resistance value of the toner with respect to each production lot or change of the charged potential of the photoreceptor by the ambient conditions if the voltage value of the a.c. development bias is maintained at the initial set value.

Meanwhile, the adjustment can be performed by a first method in which a variable resistor is employed so that an adjustment knob thereof may be manually operated by an operator, or by a second method in which a densitometer is provided separately so that a desired image density may be obtained automatically by a signal from the densitometer. Moreover, the adjustment can be performed by a third method in which the charged potential of the photoreceptor is detected so that the voltage value may be changed in accordance with the detected value, or by a fourth method in which a reference chart is provided on a rear face of a forward end of the original platform so that the toner image density corresponding to the reference chart may be detected by a photoelectric detecting means, etc. so as to change the voltage value automatically.

In accordance with the present invention, an electrostatic latent image can be subjected to reversal development efficiently by the use of high-resistivity magnetic toner, and normal development and reversal development can be performed through simplified arrangement of an electrophotographic copying apparatus of toner image transfer type so that the reversal development image of remarkably excellent quality may be obtained.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as included therein.

What is claimed is:

1. A reversal development method of visualizing an electrostatic latent image through development, comprising the steps of:

forming a magnetic brush around an outer circumferential surface of a developing sleeve accommodating a magnet therein, by the use of a developer composed of high-resistivity magnetic toner having a resistance value of $10^{13}\Omega$cm or more under an electric field of $10^4$ V/cm and a charge amount of 5 to 15 μQ/g per unit mass generated by gaseous discharge;

rubbing a surface of an electrostatic latent image carrier bearing said electrostatic latent image with said magnetic brush; and applying simultaneously to said magnetic brush during said rubbing, an a.c. bias, and a d.c. bias approximately equal to a sum of a potential of an image portion of said electrostatic latent image and a potential of a non-image portion thereof.

2. A reversal development method as claimed in claim 1, wherein said a.c. bias has a sufficient potential required for charging said high-resistivity magnetic toner forming said magnetic brush to positive and negative polarities through gaseous discharge.

3. A reversal development method as claimed in claim 2, wherein said high-resistivity magnetic toner having electric charge of the same polarity as that of electric charge held by said electrostatic latent image is electrostatically attracted to said image portion of said electrostatic latent image when said surface of said electrostatic latent image carrier is rubbed with said magnetic brush.

4. A reversal development method as claimed in claim 3, wherein said a.c. bias is applied to said magnetic brush through said developing sleeve or a bristle-height regulating member.

5. A reversal development method as claimed in claim 4, wherein said d.c. bias is applied to said magnetic brush through said developing sleeve.

6. A reversal development method as claimed in claim 4, wherein said developing sleeve is electrically conductive and is provided with an insulating coating on its outer circumferential surface.

* * * * *